US008177397B1

(12) United States Patent
Knoble et al.

(10) Patent No.: US 8,177,397 B1
(45) Date of Patent: May 15, 2012

(54) LED HEAT MANAGEMENT SYSTEM

(75) Inventors: David W. Knoble, Tupelo, MS (US); Khosrow Jamasbi, Belden, MS (US); Carlton Bruce Plunk, Saltillo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 88 days.

(21) Appl. No.: 12/650,180

(22) Filed: Dec. 30, 2009

Related U.S. Application Data

(60) Provisional application No. 61/142,115, filed on Dec. 31, 2008.

(51) Int. Cl.
*F21V 29/00* (2006.01)

(52) U.S. Cl. ..... 362/373; 362/249.02; 362/294

(58) Field of Classification Search ..... 362/249.02, 362/294, 373, 547, 218; 361/700, 703; 165/104.33
See application file for complete search history.

(56) References Cited

U.S. PATENT DOCUMENTS

| | | | | |
|---|---|---|---|---|
| 2007/0029072 | A1* | 2/2007 | Lee et al. | 165/104.33 |
| 2009/0040760 | A1* | 2/2009 | Chen et al. | 362/249 |
| 2009/0147522 | A1* | 6/2009 | Shuai et al. | 362/294 |
| 2009/0237933 | A1* | 9/2009 | Liu | 362/249.02 |
| 2009/0303717 | A1* | 12/2009 | Long et al. | 362/249.02 |

* cited by examiner

*Primary Examiner* — Laura Tso

(57) ABSTRACT

A heat management system has a first heatsink coupled to a support surface. At least one heat pipe has a heat absorbing end in thermal connectivity with the first heatsink and a heat releasing end in thermal connectivity with a second heatsink.

16 Claims, 5 Drawing Sheets

LED HEAT MANAGEMENT SYSTEM

CROSS-REFERENCE TO RELATED DOCUMENTS

This application claims priority to and benefit under 35 U.S.C. §119(e) to U.S. Provisional App. No. 61/142,115, filed on Dec. 31, 2008, entitled LED Heat Management System, the entire contents of which are hereby incorporated by reference.

TECHNICAL FIELD

This invention pertains generally to a heat management system, and more particularly to a LED heat management system.

BACKGROUND

Many lights use incandescent lamps. However, incandescent lamps or bulbs are less efficient than light emitting diodes (LEDs). LEDs are more efficient than incandescent lights and may have a longer life than incandescent lights. In order to prolong the life of LEDs, efficient dissipation of the heat generated by the LEDs is necessary.

SUMMARY

Generally, in one aspect, a heat management system includes a support surface having a first side and a second side. A first heatsink is coupled to the second side of the support surface and has a main body and a plurality of heat fins extending from the main body. A second heatsink has a heat pipe sleeve that is in thermal connectivity with and surrounded by a plurality of heat fins on the second heatsink. A heat pipe is affixed adjacent the second side of the support surface and has a heat absorbing end and a heat releasing end. The heat absorbing end is in thermal connectivity with the first heatsink and extends between a pair of the fins of the first heatsink. The heat releasing end is in thermal connectivity with and surrounded by the heat pipe sleeve of the second heatsink.

In some embodiments the heat management system further includes a second heat pipe having a heat absorbing end and a heat releasing end. The heat absorbing end of the second heat pipe extends between a pair of the fins of the first heatsink. In some versions of these embodiments the second heatsink has a second heat pipe sleeve in thermal connectivity with and surrounded by the plurality of heat fins and the heat releasing end of the second heat pipe is in thermal connectivity with and surrounded by the second heat pipe sleeve of the second heatsink In some embodiments the heat absorbing end of the heat pipe is in contact with the main body of the first heatsink. In some versions of these embodiments the heat absorbing end of the heat pipe is in contact with a contoured heat pipe seat extending from the main body of the first heatsink. In some versions of these embodiments the heat management system further includes a heat pipe clamp coupled to the first heatsink; the heat pipe clamp having at least one leg portion extending between a pair of the fins of the first heatsink. The heat absorbing end of the first heat pipe is compressed between the heat pipe seat of the first heatsink and the leg portion of the heat clamp.

In some embodiments the heat management system further includes a flexible neck member having a first end and a second end, the first end is coupled to the second heatsink. In some versions of these embodiments the first end of the flexible neck member surrounds the second heatsink and is in thermal connectivity with the second heatsink. In some versions of these embodiments the heat management system further includes a mounting base coupled to the flexible neck member proximal the second end thereof.

Generally, in another aspect, a heat management system includes a support surface having a first side and a second side. A plurality of light emitting diodes may be coupled to the first side of the support surface. A first heatsink is coupled to the second side of the support surface. The first heatsink has a main body and a plurality of heat fins extending from the main body. A second heatsink has a hollow interior and a plurality of heat fins radially extending around the hollow interior. The hollow interior houses a first heat pipe sleeve and a second heat pipe sleeve. The first heat pipe sleeve and the second heat pipe sleeve are in thermal connectivity with the plurality of heat fins. A first and second heat pipe each have a heat absorbing end and a heat releasing end. Each heat absorbing end of the first and the second heat pipe are in thermal connectivity with the first heatsink and extend between a pair of the fins of the first heatsink. The heat releasing end of the first heat pipe is in thermal connectivity with and surrounded by the first heat pipe sleeve of the second heatsink. The heat releasing end of the second heat pipe is in thermal connectivity with and surrounded by the second heat pipe sleeve of the second heatsink.

In some embodiments the heat absorbing end of each heat pipe is in contact with a corresponding heat pipe seat extending from the main body of the first heatsink. In some versions of these embodiments the heat management system further includes a heat pipe clamp coupled to the first heatsink. The heat pipe clamp has a first and second leg portion. Each leg portion extends between a pair of the fins of the first heatsink. The heat absorbing end of each heat pipe is compressed between a corresponding heat pipe seat of the first heatsink and a corresponding leg portion of the heat clamp.

In some embodiments the heat management system further includes a flexible neck member having a first end and a second end, the first end is coupled to the second heatsink. In some versions of these embodiments the first end of the flexible neck member surrounds the second heatsink and is in thermal connectivity with the second heatsink.

Generally, in another aspect, a flexible LED luminaire having a heat management system includes a support surface having a first side and a second side. A plurality of light emitting diodes are coupled to the first side of the support surface and electrically connected to a power source. A first heatsink is coupled to the second side of the support surface. A second heatsink is provided having a first heat pipe sleeve. A first heat pipe is provided having a heat absorbing end and a heat releasing end. The heat absorbing end is in thermal connectivity with the first heatsink and the heat releasing end is in thermal connectivity with and surrounded by the first heat pipe sleeve of the second heatsink. A housing surrounds the first heatsink. A flexible neck member has a first end coupled to the second heatsink and a second end distal the first end. A mounting base is coupled to the flexible member proximal the second end thereof.

In some embodiments the flexible LED luminaire further includes a second heat pipe having a heat absorbing end and a heat releasing end. The heat absorbing end is in thermal connectivity with the first heatsink. In some versions of these embodiments the heat releasing end of the second heat pipe is in thermal connectivity with and surrounded by a second heat pipe sleeve of the second heatsink.

In some embodiments the first heatsink has a plurality of heat fins and the heat absorbing end of the first heat pipe extends between the heat fins.

In some embodiments the first end of the flexible neck member surrounds the second heatsink.

In some embodiments the housing has a plurality of vents therethrough.

BRIEF DESCRIPTION OF THE ILLUSTRATIONS

DETAILED DESCRIPTION

Figure 1:
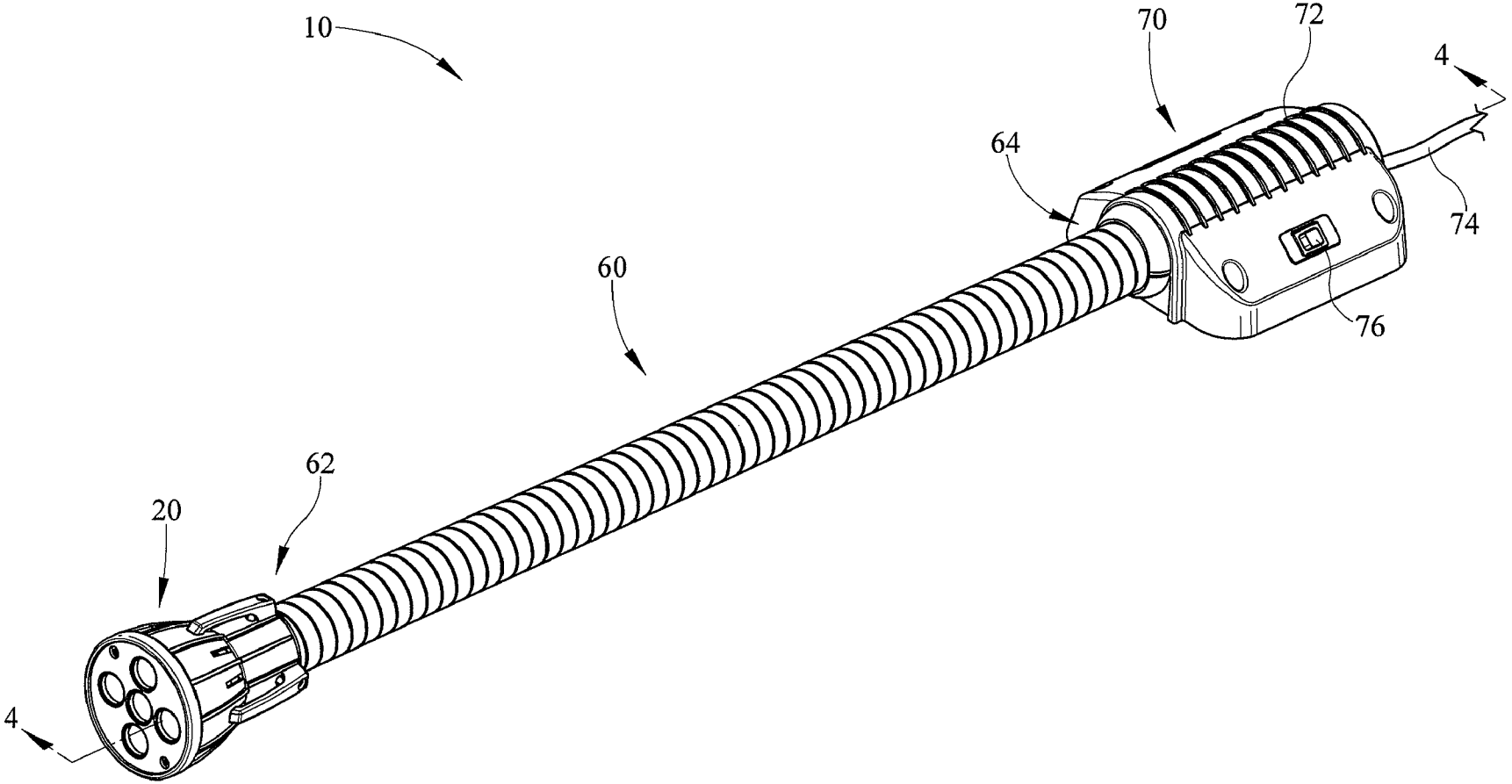
FIG. 1 is a perspective view of a first embodiment of a flexible light emitting diode luminaire utilizing an embodiment of a heat management system of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

With reference to FIG. 1 through FIG. 5, a first embodiment of a flexible LED luminaire 10 is shown. The terms "LED" and "light emitting diode" as used herein are meant to be interpreted broadly and can include, but are not limited to, an LED of any luminosity and any light distribution pattern, and also includes, but is not limited to, an organic light emitting diode (OLED). With reference to FIG. 1, flexible LED luminaire 10 has a head 20 and a mounting base 70 with a flexible neck 60 extending between head 20 and mounting base 70. Mounting base 70 may be removably or fixedly coupled to a mounting surface such as, for example, a wall or an I-beam in a warehouse. In some embodiments a plurality of apertures may be provided in mounting base 70 for receiving mounting hardware such as a stud or a bolt. Mounting base 70 has a ballast housing 72 that encloses a light emitting diode power supply. In some embodiments the light emitting diode power supply is configured to receive a 120 Volt input and provide fifteen Watts of power to LEDs. In other embodiments of luminaire 10 light emitting diode power supplies may be located elsewhere on flexible LED luminaire 10, located remotely from LED luminaire 10, or omitted. An electrical cord 74 extends from mounting base 70 and may be coupled to an external power source to provide electrical power to light emitting diode power supplies enclosed within housing 72. In other embodiments of luminaire 10 electrical cord 74 may be omitted and a power source internal to flexible LED luminaire 10 may be used. A switch 76 is located on ballast housing 72 and may be actuated to selectively power flexible LED luminaire 10. In other embodiments of luminaire 10 switch 76 may be located on head 20, flexible neck 60, or located remotely from flexible LED luminaire 10, or omitted. In some embodiments an electrical Flexible neck 60 has a first end 62 coupled to head 20 and a second end 64 coupled to ballast housing 72. Flexible neck 60 may be adjusted to and temporarily fixed at a plurality of orientations to enable head 20 to be directed toward a desired illumination area. Flexible neck 60 may be readjusted to and temporarily fixed to another orientation as desired. In some embodiments of luminaire 10 flexible neck 60 may house electrical wiring that extends from mounting base 70 to head 20. In some embodiments of luminaire 10 flexible neck 60 may be constructed from a metal having desirous heat distribution properties such as, but not limited to, stainless steel or aluminum.

With continuing reference to FIGS. 1-5, a housing 22, a bezel 24, and a gasket 26 enclose an embodiment of LED heat management system 30. A lens, 25, shown in FIG. 4, may be placed over bezel 24 if desired to, for example, seal housing 22 or to alter optical characteristics of light exiting through lens 25. Housing 22 may be provided with one or more vents 23 therethrough to allow for better airflow and heat dissipation. In some embodiments housing 22 is constructed from a metal having desirable heat distribution properties, such as, but not limited to, aluminum or stainless steel. The exemplary embodiment of LED heat management system 30 has a support surface 32 having five LED optical pieces 34 placed over five corresponding LEDs 35, shown in phantom in FIG. 4, that are coupled to support surface 32. Optical pieces 34 include a reflector **34*a* substantially surrounding each LED 35 and having a lens on an opposite end of the reflector 34*a*. In some embodiments support surface 32 may be a flame retardant four (FR-4) or other common printed circuit board. In other embodiments support surface 32 is a metallic board with advantageous heat distribution properties such as, but not limited to, aluminum. In some embodiments support surface 32 is a metal clad circuit board with an aluminum core. In other embodiments support surface 32 is a shape other than circular. In some embodiments optical pieces 34 and reflector 34*a* and their corresponding LEDs 35 are configured to produce a narrow beam light distribution so that far away areas may be appropriately illuminated. In some embodiments reflectors 34*a* are configured to direct light emitted by LEDs 35 into narrow beams that will sufficiently illuminate a far end of a common semi trailer when the luminaire 10 is located at a near end of the semi trailer that is distal the far end. In some embodiments each LED 35** consumes approximately three watts of power and outputs approximately 180 lumens.

A first heatsink 40 is couple to and in thermal connectivity with support surface 32. In some embodiments heatsink 40 may be constructed from a metal having desirable heat distribution properties, such as, but not limited to, aluminum. Heatsink 40 has a main body portion 42 and a plurality of heat fins 44 extending away from main body portion 42. A thermal layer 33 is provided between support surface 32 and first heatsink 40 to aid in heat dissipation. In some embodiments thermal layer 33 may be a thermal pad and in other embodiments thermal layer 33 may be a thermal compound, such as, but not limited to a thermal silicon paste. Thermal layer 33 may be omitted in other embodiments if not desired for heat dissipation. Two heat pipes 46 each have a heat absorbing end 47 and a heat releasing end 48. In some embodiments heat pipes 46 are constructed from Copper or Aluminum and filled with a coolant such as, but not limited to, water, ethanol, or acetone. Heat absorbing end 47 of each heat pipe 46 is in thermal connectivity with first heatsink 40 and extends between two heat fins 44. In the depicted embodiment two heat pipe seats 43 are provided, each extending from main body portion 42 between two heat fins 44. Heat absorbing end 47 of each heat pipe 46 is received in a corresponding heat pipe seat 43. A heat pipe clamp 45 may be coupled to first heatsink 40 and secured to appropriately compress heat absorbing end 47 of each heat pipe 46 between heat pipe clamp 45 and heat pipe seat 43. Heat pipe clamp 45 may absorb some heat from heatsink 40 and transfer heat to heat pipes 46 through contact with heat pipes 46. Heat pipe seats 43 generally conform to the contour of each heat pipe absorbing end 47 to increase the surface area that is contacting heat absorbing end 47. In other embodiments heat pipe seats 43 may be modified to provide more or less surface area, to correspond to a different shape of heat pipe absorbing end 47, or may be omitted. In some embodiments heat pipe clamp 45 may be omitted and heat pipes 46 may be otherwise maintained in position.

First heatsink 40 dissipates heat generated by the LEDs provided on support surface 32. Some of the heat is dissipated by main body 42 and some is dissipated by heat fins 44. Some of the heat is transferred from heatsink 40 to heat pipe absorbing end 47 of each heat pipe 46. Each heat pipe 46 transfers heat from heat absorbing end 47 to heat dissipating end 48 which is housed in a second heatsink 50. Second heatsink 50 has two heat pipe sleeves 52 that are in thermal connectivity with and surrounded by a plurality of heat fins 54. In some embodiments second heatsink 50 may be constructed from a metal having desirable heat distribution properties, such as, but not limited to, aluminum. Heat is transferred from heat dissipating end 48 of each heat pipe 46 to heat pipe sleeves 52, heat fins 54, and other portions of second heat sink 50. Heat may also be transferred from first heatsink 40 and/or second heatsink 50 to housing 22 and dissipated into the external environment. Wiring 5 may extend from neck 60 through second heatsink 50 to provide power to the LEDs 35 on support surface 32.

Figure 2:
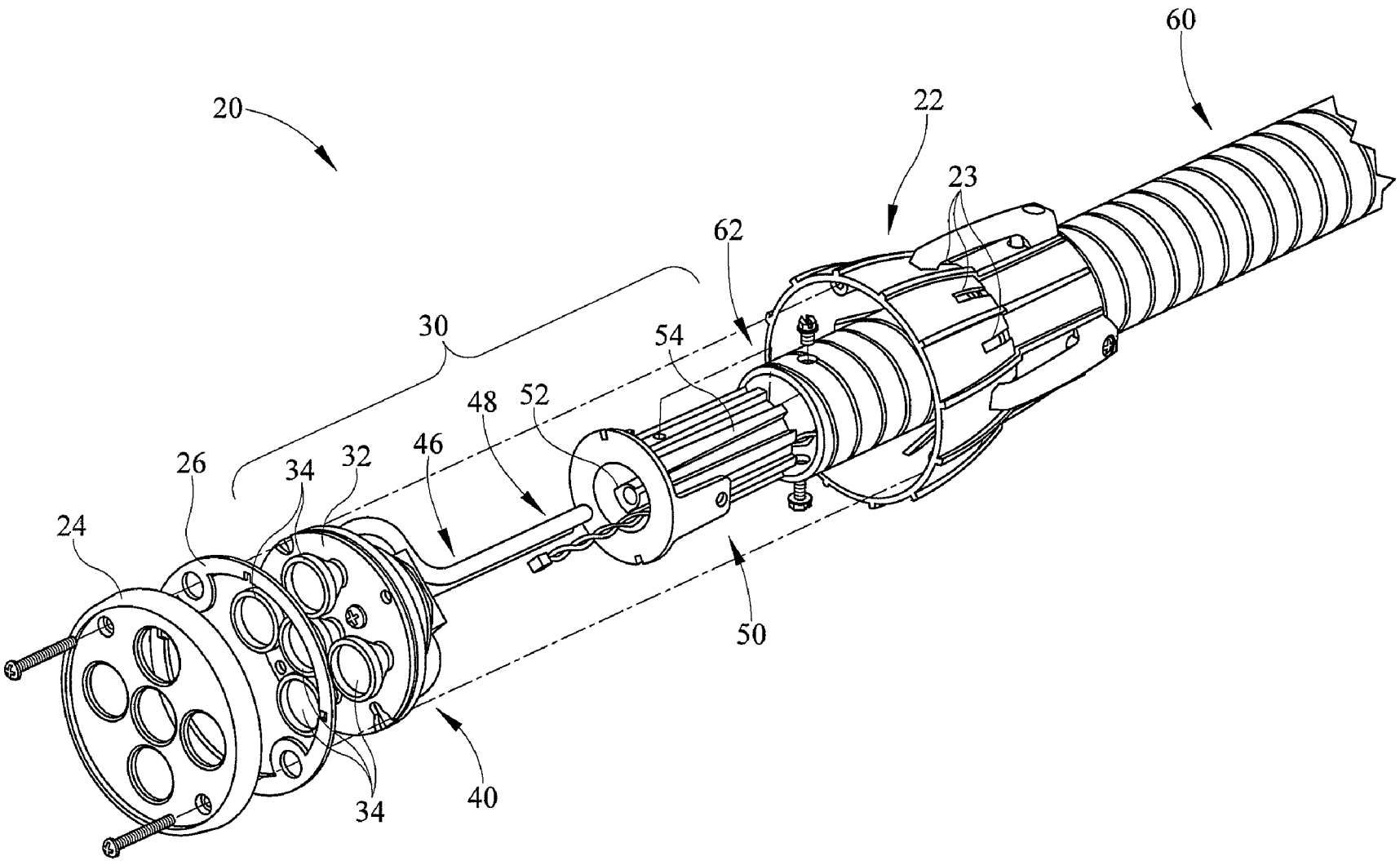
FIG. 2 is an exploded perspective view of a light emitting diode head of the flexible light emitting diode luminaire of FIG. 1 showing the embodiment of the heat management system of the flexible light emitting diode luminaire of FIG. 1.
Figure 3:
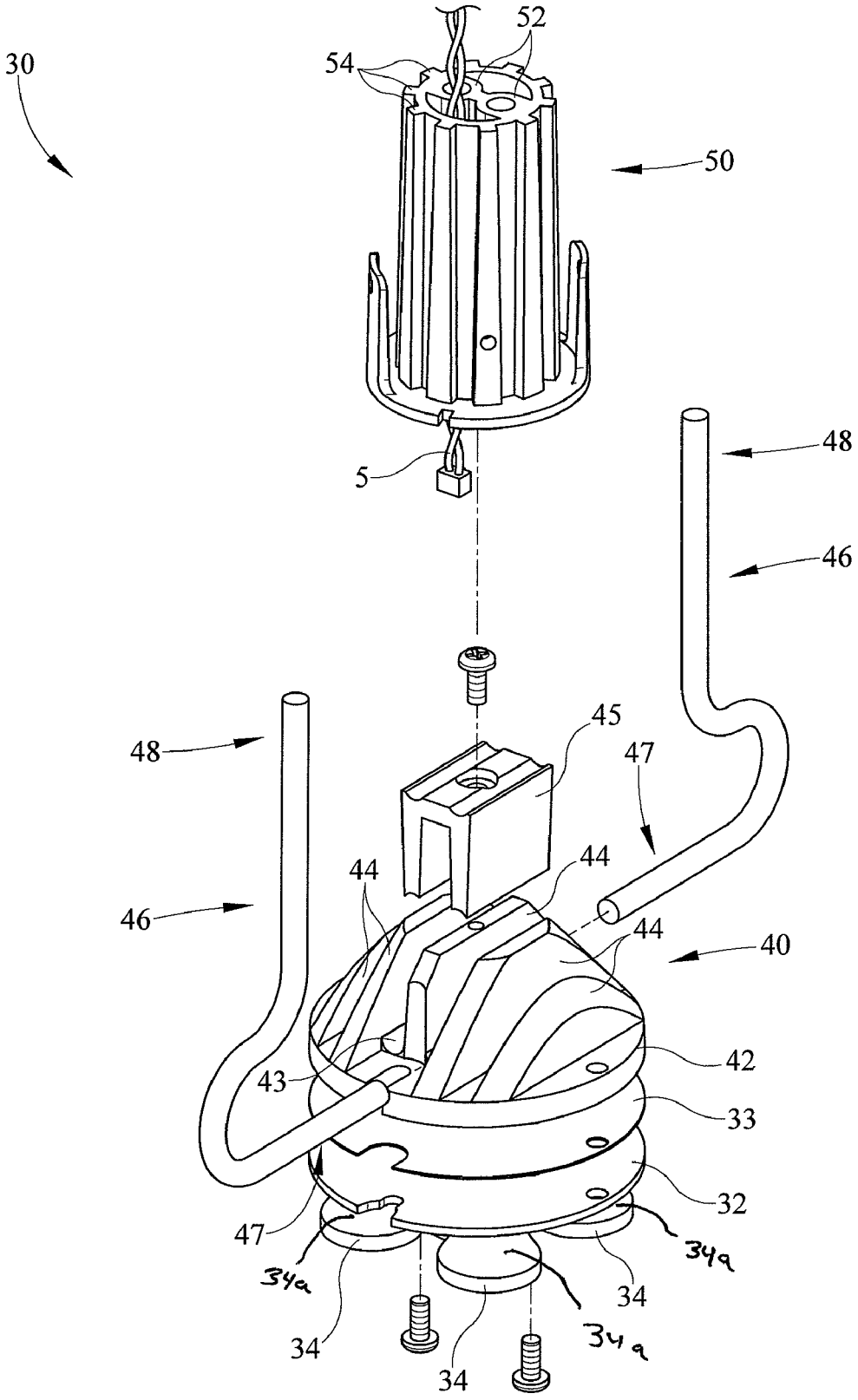
FIG. 3 is an exploded perspective view of the embodiment of the heat management system of the flexible light emitting diode luminaire of FIG. 1.
Figure 4:
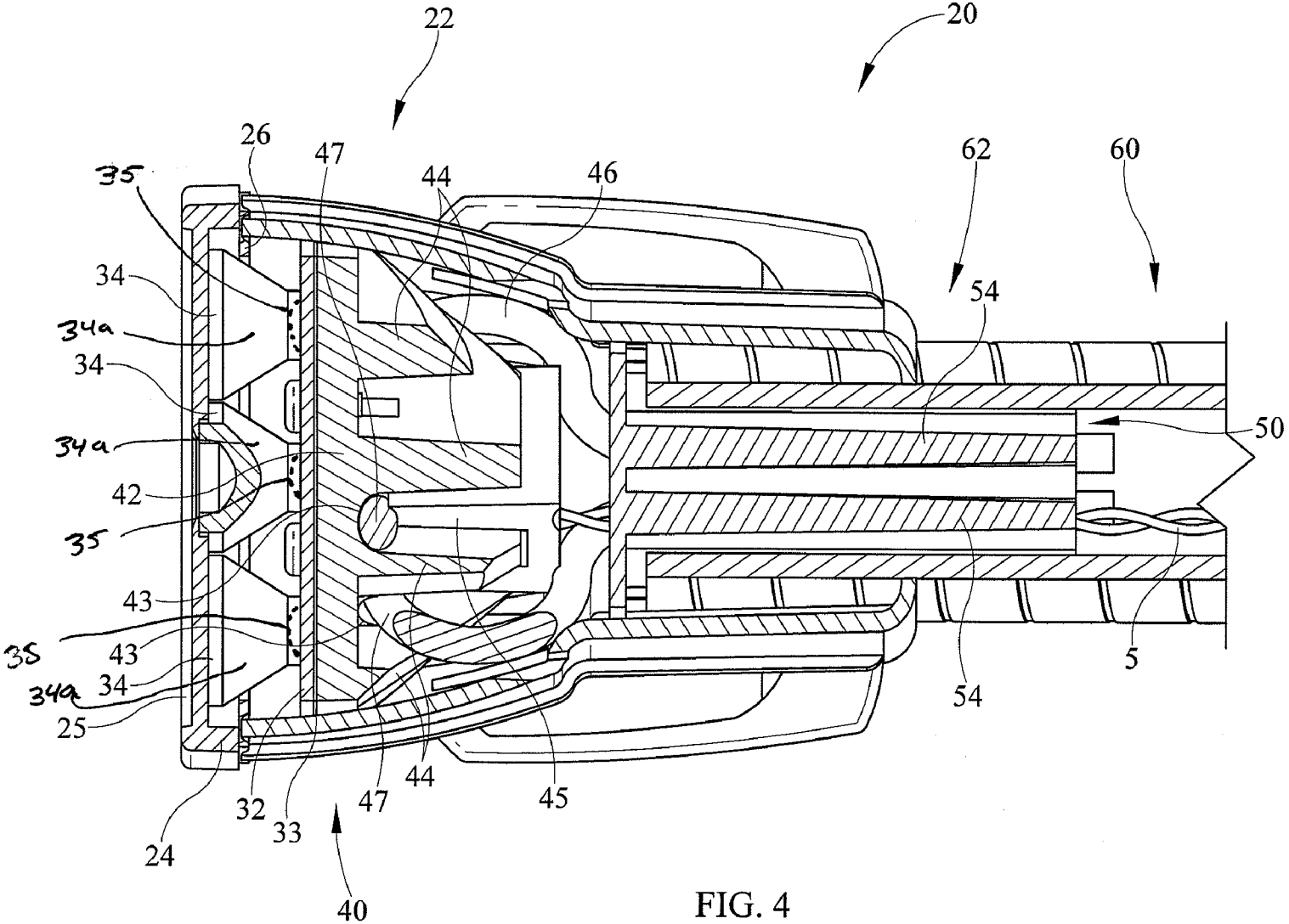
FIG. 4 is a side view, in section, of the light emitting diode head and a portion of the flexible neck of the flexible light emitting diode luminaire of FIG. 1 taken along the line 4-4 of FIG. 1.
Figure 5:
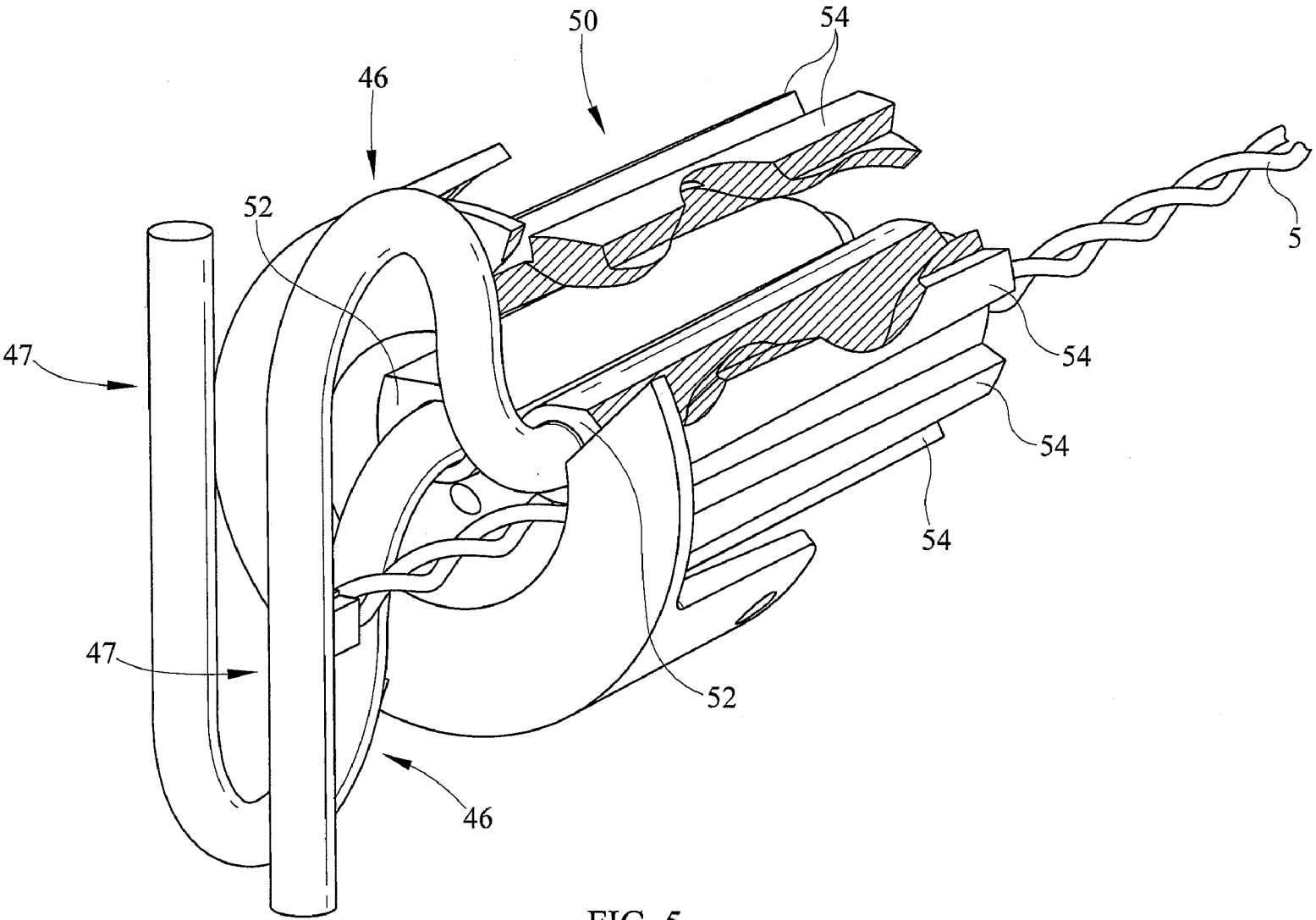
FIG. 5 is a perspective view of a first and second heat pipe and a second heatsink of the heat management system of FIG. 3, with a portion of the second heatsink broken away.

With particular reference to FIG. 2 and FIG. 4, first end 62 of flexible neck 60 is coupled to and surrounds a portion of second heatsink 50. First end 62 may contact or be sufficiently close to second heatsink 50 so as to allow heat to be transferred from second heatsink 50 to flexible neck 60 to aid in dissipation of heat. In other embodiments of luminaire 10 first end 62 of flexible neck 60 may be otherwise coupled to head 20. It should be noted that in FIG. 2 first end 62 of flexible neck 60 is shown exploded away from the remainder of neck 60 for clarity. In the unexploded state of the exemplary embodiment first end 62 of flexible neck 60 will be recessed into housing 22 as shown in FIG. 4.

First heatsink 40, heat pipes 46, and second heatsink 50 provide efficient heat dissipation for LEDs 35 mounted on support surface 32. Although first heatsink 40, heat pipes 46, and second heatsink 50 have been described in detail herein, many variations are possible. For example, in some embodiments only one heat pipe 46 may be provided, or heat pipes 46 may be coupled to one another at their heat absorbing ends 46 to form one continual heat pipe. For example, in other embodiments more than two heat pipes 46 may be provided. Also, for example, in some embodiments only a single heat pipe sleeve 52 may be provided in second heatsink 50 and it may surround just a single heat pipe 64 or it may surround multiple heat pipes 64.

The foregoing description has been presented for purposes of illustration. It is not intended to be exhaustive or to limit the invention to the precise forms disclosed, and obviously many modifications and variations are possible in light of the above teaching. It is understood that while certain forms of the LED heat management system have been illustrated and described, it is not limited thereto except insofar as such limitations are included in the following claims and allowable functional equivalents thereof.

We claim:

1. A heat management system comprising:

a support surface having a first side and a second side;

a first heatsink coupled to said second side of said support surface, said first heatsink having a main body and a plurality of heat fins extending from said main body;

a second heatsink having a heat pipe sleeve, said heat pipe sleeve in thermal connectivity with and surrounded by a plurality of heat fins on said second heatsink;

a heat pipe affixed adjacent said second side of said support surface and having a heat absorbing end and a heat releasing end, said heat absorbing end in thermal connectivity with said first heatsink and extending between a pair of said fins of said first heatsink, said heat releasing end in thermal connectivity with and surrounded by said heat pipe sleeve of said second heatsink;

further comprising a second heat pipe having a heat absorbing end and a heat releasing end, said heat absorbing end extending between a pair of said fins of said first heatsink;

wherein said second heatsink has a second heat pipe sleeve in thermal connectivity with and surrounded by said plurality of heat fins and wherein said heat releasing end of said second heat pipe is in thermal connectivity with and surrounded by said second heat pipe sleeve of said second heatsink.

2. A heat management system comprising:

a support surface having a first side and a second side;

a first heatsink coupled to said second side of said support surface, said first heatsink having a main body and a plurality of heat fins extending from said main body;

a second heatsink having a heat pipe sleeve, said heat pipe sleeve in thermal connectivity with and surrounded by a plurality of heat fins on said second heatsink; and a heat pipe affixed adjacent said second side of said support surface and having a heat absorbing end and a heat releasing end, said heat absorbing end in thermal connectivity with said first heatsink and extending between a pair of said fins of said first heatsink, said heat releasing end in thermal connectivity with and surrounded by said heat pipe sleeve of said second heatsink;

further comprising a second heat pipe having a heat absorbing end and a heat releasing end, said heat absorbing end extending between a pair of said fins of said first heatsink;

wherein said second heatsink has a second heat pipe sleeve in thermal connectivity with and surrounded by said plurality of heat fins and wherein said heat releasing end of said second heat pipe is in thermal connectivity with and surrounded by said second heat pipe sleeve of said second heatsink;

wherein said heat absorbing end of said heat pipe is in contact with said main body of said first heatsink;

wherein said heat absorbing end of said heat pipe is in contact with a contoured heat pipe seat extending from said main body of said first heatsink;

further comprising a heat pipe clamp coupled to said first heatsink, said heat pipe clamp having at least one leg portion extending between a pair of said fins of said first heatsink, wherein said heat absorbing end of said first heat pipe is compressed between said heat pipe seat of said first heatsink and said leg portion of said heat clamp.

3. A heat management system comprising:

a support surface having a first side and a second side;

a first heatsink coupled to said second side of said support surface, said first heatsink having a main body and a plurality of heat fins extending from said main body;

a second heatsink having a heat pipe sleeve, said heat pipe sleeve in thermal connectivity with and surrounded by a plurality of heat fins on said second heatsink; and a heat pipe affixed adjacent said second side of said support surface and having a heat absorbing end and a heat releasing end, said heat absorbing end in thermal connectivity with said first heatsink and extending between a pair of said fins of said first heatsink, said heat releasing end in thermal connectivity with and surrounded by said heat pipe sleeve of said second heatsink;

further comprising a second heat pipe having a heat absorbing end and a heat releasing end, said heat absorbing end extending between a pair of said fins of said first heatsink;

wherein said second heatsink has a second heat pipe sleeve in thermal connectivity with and surrounded by said plurality of heat fins and wherein said heat releasing end of said second heat pipe is in thermal connectivity with and surrounded by said second heat pipe sleeve of said second heatsink;

further comprising a flexible neck member having a first end and a second end, said first end coupled to said second heatsink.

4. The heat management system of claim 3, wherein said first end of said flexible neck member surrounds and is in direct contact with said second heatsink.

5. The heat management system of claim 4 further comprising a mounting base, said mounting base coupled to said flexible neck member proximal said second end thereof.

6. A heat management system comprising:

a support surface having a first side and a second side, said first side configured to support at least one light emitting diode thereon;

a first hcatsink coupled to said second side of said support surface, said first heatsink having a main body and a plurality of heat fins extending from said main body;

a second hcatsink having a hollow interior and a plurality of heat fins radially extending around said hollow interior, said hollow interior housing a first heat pipe sleeve and a second heat pipe sleeve, said first heat pipe sleeve and said second heat pipe sleeve in thermal connectivity with said plurality of heat fins;

a first and second heat pipe each having a heat absorbing end and a heat releasing end, each said heat absorbing end of said first and said second heat pipe in thermal connectivity with said first heatsink and extending between a pair of said fins of said first hcatsink, said heat releasing end of said first heat pipe in thermal connectivity with and surrounded by said first heat pipe .sleeve of said second heatsink, and said heat releasing end of said second heat pipe in thermal connectivity with and surrounded by said second heat pipe sleeve of said second heatsink.

7. The heat management system of claim 6, wherein said heat absorbing end of each said heat pipe is in contact with a corresponding heat pipe seat extending from said main body of said first heatsink.

8. The heat management system of claim 7, further comprising a heat pipe clamp coupled to said first hcatsink, said heat pipe clamp having a first and second leg portion, each said leg portion extending between a pair of said fins of said first heatsink, wherein said heat absorbing end of each said heat pipe is compressed between a corresponding said heat pipe seat of said first hcatsink and a corresponding said leg portion of said heat clamp.

9. The heat management system of claim 6, further comprising a flexible neck member having a first end and a second end, said first end coupled to said second heatsink.

10. The heat management system of claim 9, wherein said first end of said flexible neck member surrounds and is in direct contact with said second heatsink.

11. A flexible LED luminaire having a heat management system comprising:

a support surface having a first side and a second side;

a plurality of light emitting diodes coupled to said first side of said support surface and electrically connected to a power source;

a first heatsink coupled to said second side of said support surface;

a second heatsink having a first heat pipe sleeve;

a first heat pipe having a heat absorbing end and a heat releasing end, said heat absorbing end in thermal connectivity with said first heatsink and said heat releasing end in thermal connectivity with and surrounded by said first heat pipe sleeve of said second heatsink;

a housing surrounding said first heatsink;

a flexible neck member having a first end and a second end, said first end coupled to said second heatsink; and a mounting base coupled to said flexible neck member proximal said second end.

12. The flexible LED luminaire of claim 11, further comprising a second heat pipe having a heat absorbing end and a heat releasing end, said heat absorbing end in thermal connectivity with said first heatsink.

13. The flexible LED luminaire of claim 12, wherein said heat releasing end of said second heat pipe is in thermal connectivity with and surrounded by a second heat pipe sleeve of said second heatsink.

14. The flexible LED luminaire of claim 11, wherein said first heatsink has a plurality of heat fins and said heat absorbing end of said first heat pipe extends between said heat fins.

15. The flexible LED luminaire of claim 11, wherein said first end of said flexible neck member surrounds said second heatsink.

16. The flexible LED luminaire of claim 11, wherein said housing has a plurality of vents therethrough.

* * * * *